US006959653B1

(12) United States Patent
Mann et al.

(10) Patent No.: US 6,959,653 B1
(45) Date of Patent: Nov. 1, 2005

(54) FUEL NOZZLE FOR A FOSSIL FUEL FIRED COMBUSTION ARRANGEMENT

(75) Inventors: Jeffrey Scott Mann, Windsor, CT (US); Christopher Gerald Muller, Enfield, CT (US); Ronald Henry Nowak, E. Longmeadow, MA (US)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/829,878

(22) Filed: Apr. 22, 2004

(51) Int. Cl.[7] ..... F23D 1/00
(52) U.S. Cl. ..... 110/263; 110/104 B
(58) Field of Search ..... 239/587.5, 587.6; 110/260, 261, 262, 263, 264, 265, 266

(56) References Cited

U.S. PATENT DOCUMENTS 4,520,739 A * 6/1985 McCartney et al. ..... 110/263
5,435,492 A * 7/1995 Tenerowicz ..... 239/587.6
5,820,457 A * 10/1998 Kern et al. ..... 454/315
6,145,764 A * 11/2000 Gonzalez et al. ..... 239/587.6

* cited by examiner

*Primary Examiner*—Kenneth Rinehart
(74) *Attorney, Agent, or Firm*—Arthur E. Fournier, Jr.

(57) ABSTRACT

A pivot mounting apparatus 210 is provided for pivotally mounting to one another the coal nozzle tip 212 and coal nozzle body 214 of a pulverized solid fuel nozzle 208 of a pulverized solid fuel-fired furnace 10. The pivot mounting apparatus 210 includes a latch interconnecting assembly 220 that includes a pin 222 for insertion in a traversing movement through an insertion passage 224 which passes through both the through hole 216 of the coal nozzle tip 212 and the through hole 218 of the coal nozzle body 214 upon the mutually facing positioning of respective sides of the coal nozzle tip 212 and the coal nozzle body 214 with one another with their respective through holes 216, 218 both co-axial with an insertion axis IAX.

6 Claims, 15 Drawing Sheets

FUEL NOZZLE FOR A FOSSIL FUEL FIRED COMBUSTION ARRANGEMENT

BACKGROUND OF THE INVENTION

The present invention relates to a fuel nozzle for a fossil fuel fired combustion arrangement of the type having fossil fuel delivery systems that deliver pulverized coal to coal fired steam generators and more specifically, to a pulverized solid fuel nozzle having a pulverized solid nozzle tip pivotally mounted relative to the pulverized solid nozzle body of the pulverized solid fuel nozzle.

It has long been known in the prior art to employ pulverized solid fuel nozzle tips in firing systems of the type that are utilized in pulverized solid fuel-fired furnaces. U.S. Pat. No. 2,895,435 discloses a tilting nozzle designed to provide substantially uniform distribution of the fuel-air mixture leaving the tilting nozzle and substantially uniform velocity across the discharge opening of the tilting nozzle into the furnace. To this end, the tilting nozzle includes an inner conduit within an outer conduit and a plurality of baffles or division walls within the inner conduit arranged in planes substantially parallel to fluid flow which divide the inner conduit into a multiplicity of parallel channels. U.S. Pat. No. 4,274,343 discloses a fuel-fired admission assembly of the type incorporating a split coal bucket having an upper and a lower coal nozzle pivotally mounted to the coal delivery pipe and independently tiltable of each other. A plate is disposed along the longitudinal axis of the coal delivery pipe with its leading edge oriented across the inlet end of the coal delivery pipe so that that portion of the primary air pulverized coal stream having a high coal concentration enters the coal delivery pipe on one side of the plate and that portion of the primary air-pulverized coal stream having a low coal concentration enters the coal delivery pipe on one side of the plate and that portion of the primary air-pulverized coal stream having a low coal concentration enters the coal delivery pipe on the other side of the plate.

Although the pulverized solid fuel nozzles that form the subject matter of the above-noted U.S. patents have been demonstrated to be operative for their intended purposes, there has nevertheless been evidenced in the prior art a need for such pulverized solid fuel nozzles to be further improved. In this regard, there is a need for an apparatus that permits a straightforward and reliable installation and de-installation of the pivot mounting by which the pulverized solid nozzle tip of a pulverized solid fuel nozzle and the pulverized solid nozzle body of the pulverized solid fuel nozzle are pivotally connected to one another.

SUMMARY OF THE INVENTION

It is an object of the present invention to provide to a pulverized solid fuel nozzle having a pulverized solid nozzle tip pivotally mounted relative to the pulverized solid nozzle body of the pulverized solid fuel nozzle that will advantageously permit a straightforward and reliable installation and de-installation of the pivot mounting by which the pulverized solid nozzle tip of a pulverized solid fuel nozzle and the pulverized solid nozzle body of the pulverized solid fuel nozzle are pivotally connected to one another.

Another object of the invention to provide to a pulverized solid fuel nozzle having a pulverized solid nozzle tip pivotally mounted relative to the pulverized solid nozzle body of the pulverized solid fuel nozzle that will advantageously permit installation and de-installation of the pivot mounting by an access path interiorly of the pulverized solid nozzle tip.

The afore-mentioned objects of the present invention are achieved, in accordance with one aspect of the present invention, by an apparatus for pivotally mounting one side of a coal nozzle tip of a coal nozzle operable in a pulverized solid fuel-fired furnace to a coal nozzle body of the coal nozzle, wherein the one side of the coal nozzle tip having a through hole therethrough and the coal nozzle tip and the coal nozzle body are mounted relative to one another such that the one side of the coal nozzle tip is outward of the coal nozzle body. The apparatus includes a latch interconnecting assembly having a pin for insertion in a traversing movement along an insertion axis through both the through hole of the coal nozzle tip and a correspondingly aligned pivot support hole of the coal nozzle body.

In accordance with further features of the one aspect of the present invention, the pin has a traverse end and an inside end with the traverse end of the pin being inserted during the traversing movement initially through the pivot support hole of the coal nozzle body and thereafter through the through hole of the one side of the coal nozzle tip, whereupon, in the fully inserted position of the pin, the traverse end of the pin is outward of the one side of the coal nozzle body and the inside end of the pin is inward of the coal nozzle body. Also, the apparatus includes an engagement element for resisting a withdrawal movement of the pin in a direction opposite to its traversing movement, the engagement element being reversibly movable between a deployed position in which the engagement element engages the pin to resist withdrawal movement of the pin in a direction opposite to its traversing movement and a non-deployed position in which resistance of withdrawal movement of the pin by the engagement element is insufficient to prevent withdrawal of the pin from the throughhole of the coal nozzle tip. The path of movement of the engagement element between its deployed position and its non-deployed position is such that, throughout such movement of the engagement element, the path of movement of the engagement element can be intersected by a radial plane passing through the pin perpendicular to the insertion axis.

DETAILED DESCRIPTION OF THE PREFERRED EMBODIMENTS

Figure 1:
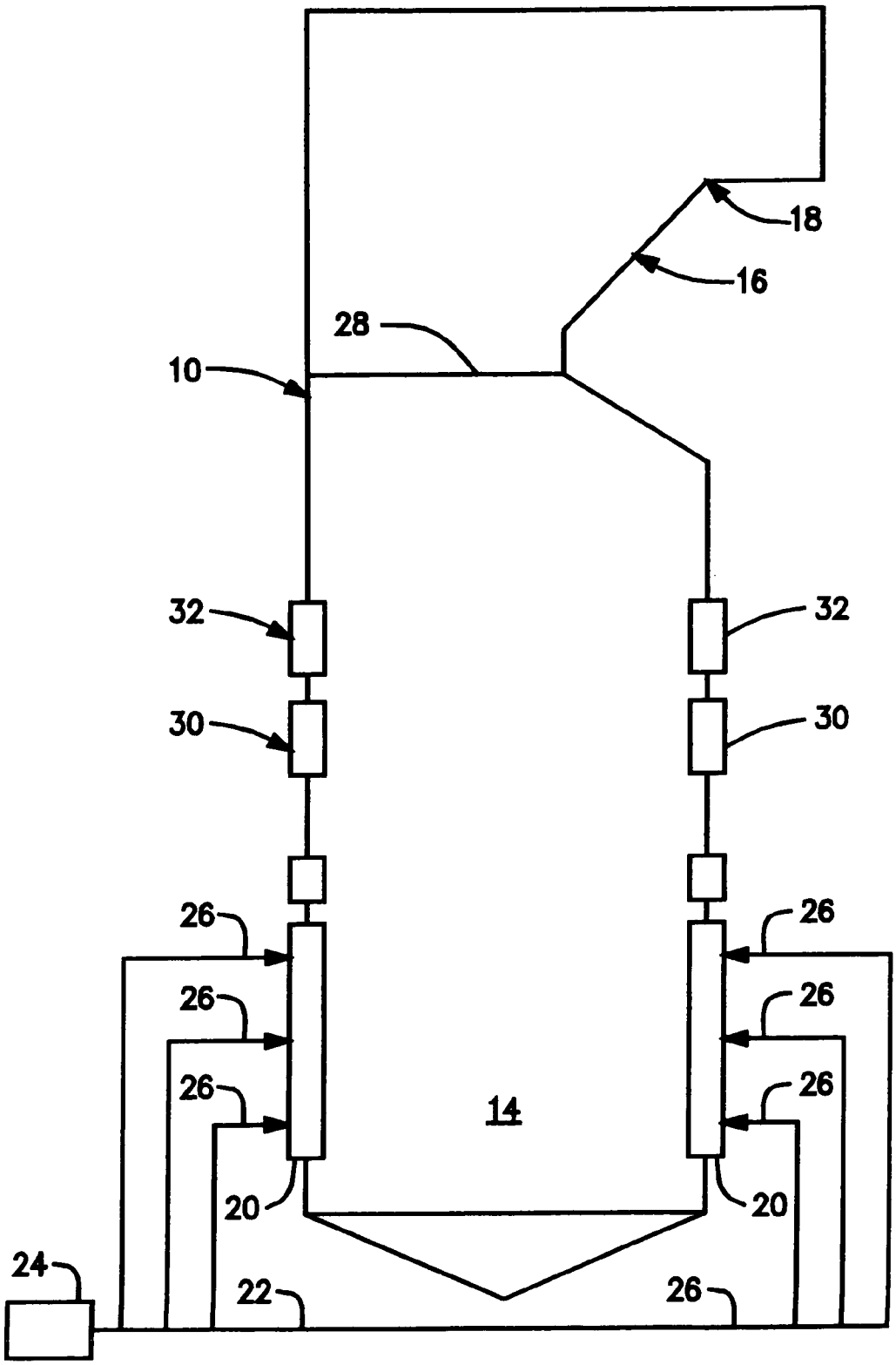
FIG. 1 is a diagrammatic representation in the nature of a vertical sectional view of a pulverized solid fuel-fired furnace having a solid fuel nozzle in which the of the inventive pivot mounting apparatus of the present invention may be utilized.

Referring now to FIG. 1, there is depicted therein a pulverized solid fuel-fired furnace 10 having a burner region 14 within which the combustion of pulverized solid fuel and air is initiated and a plurality of fuel compartments 12 through which the pulverized solid fuel is injected into the burner region 14. The hot gases that are produced from combustion of the pulverized solid fuel and air rise upwardly in the pulverized solid fuel-fired furnace 10 and give up heat to the fluid passing through the tubes (not shown in the interest of maintaining clarity of illustration in the drawing) that in conventional fashion line all four of the walls of the pulverized solid fuel-fired furnace 10. Then, the hot gases exit the pulverized solid fuel-fired furnace 10 through a horizontal pass 16 of the pulverized solid fuel-fired furnace 10, which in turn leads to a rear gas pass 18 of the pulverized solid fuel-fired furnace 10. Both the horizontal pass 16 and the rear gas pass 18 commonly contain other heat exchanger surface (not shown) for generating and superheating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in know fashion is cooperatively associated with the turbine, such that electricity is thus produced from the generator (not shown).

The pulverized solid fuel-fired furnace 10 includes a housing preferably in the form of a main windbox 20 that is provided with a plurality of air compartments (not shown) through which air supplied from a suitable source thereof (not shown) is injected into the burner region 14 of the pulverized solid fuel-fired furnace 10. In addition, within the windbox 20, the plurality of fuel compartments 12 inject solid fuel into the burner region 14 of the pulverized solid fuel-fired furnace 10. The solid fuel is supplied to the plurality of fuel compartments 12 by means of a pulverized solid fuel supply means 22 that includes a pulverizer 24 and a plurality of pulverized solid fuel ducts 26. The pulverized solid fuel is transported through the pulverized solid fuel ducts 26 from the pulverizer 24 to which the pulverized solid fuel ducts 26 are connected in fluid flow relation to the plurality of fuel compartments 12 to which the pulverized solid fuel ducts 26 are also connected in fluid flow relation. Although not shown in the interest of maintaining clarity of illustration in the drawing, the pulverizer 24 is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer 24 whereby the pulverized solid fuel supplied from the pulverizer 24 to the aforesaid plurality of fuel compartments (not shown) is transported through the pulverized solid fuel ducts 26 in an air stream in a manner which is well known to those skilled in the art of pulverizers. The pulverized solid fuel-fired furnace 10 is exemplarily provided with two or more discrete levels of separated overfire air incorporated in each corner of the pulverized solid fuel-fired furnace 10 so as to be located between the top of the main windbox 20 and a furnace outlet plane 28 of the pulverized solid fuel-fired furnace 10, i.e., a low level of separated overfire air 30 and a high level of separated overfire air 32.

Figure 2:
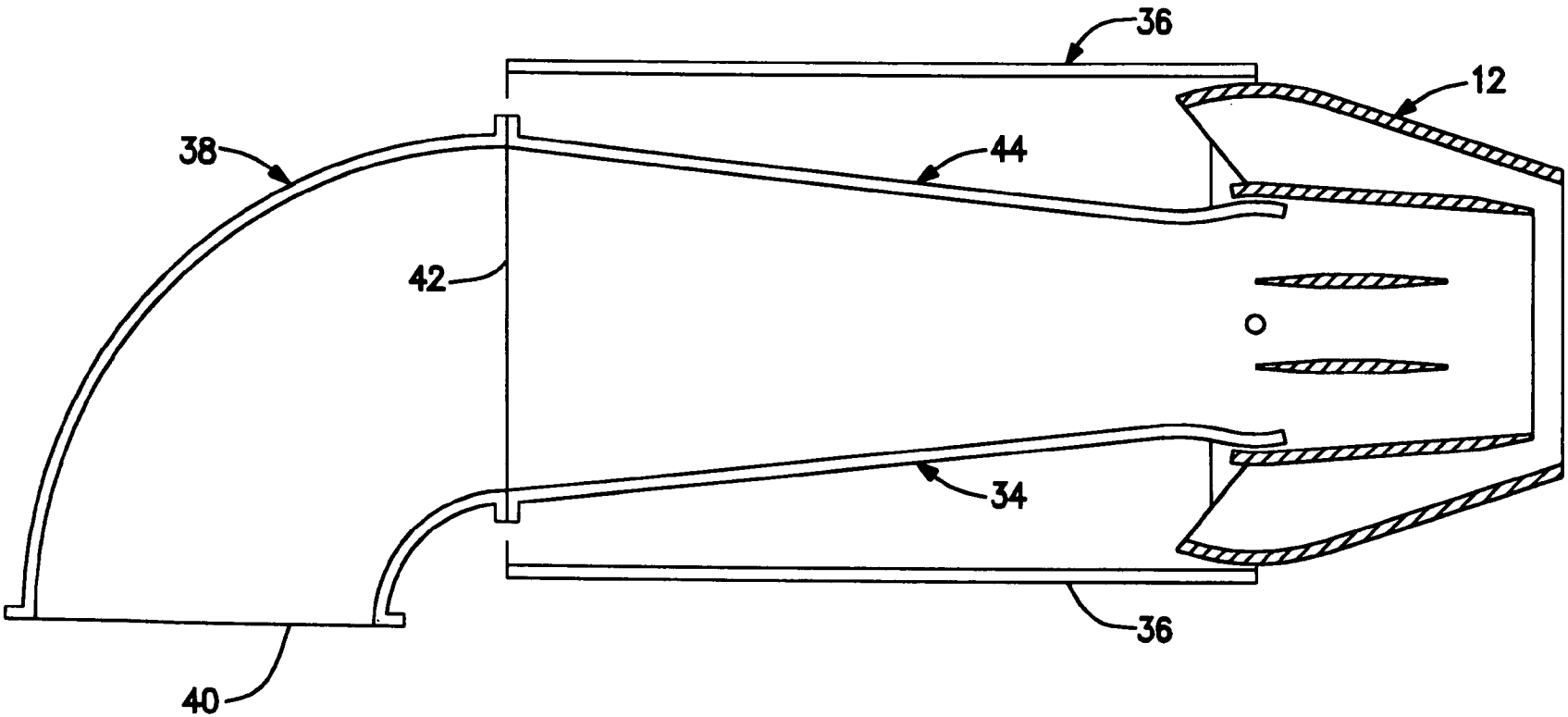
FIG. 2 is a side elevational view of a pulverized solid fuel nozzle of the type employed in the firing system of the pulverized solid fuel-fired furnace that is illustrated in FIG. 1.

Referring next to FIG. 2 of the drawings, which is a schematic representation of one of the plurality of fuel compartments 12, it can be seen that each fuel compartment 12 comprises a pulverized solid fuel nozzle 34 suitably supported in mounted relation within the fuel compartment 12 and a fuel nozzle tip 36. Any conventional form of mounting means suitable for use for such a purpose may be employed to mount the pulverized solid fuel nozzle 34 in the fuel compartment 12. The pulverized solid fuel nozzle 34 includes an elbow-like portion 38 that is designed, although it has not been depicted in FIG. 2 in the interest of maintaining clarity of illustration therewithin, to be operatively connected at one end 40 to one of the pulverized solid fuel ducts 26. The other end 42 of the elbow-like portion 38 is operatively connected through the use of any conventional form of fastening means suitable for use for such a purpose to a longitudinally extending portion 44, whose length is such as to essentially correspond to the depth of the fuel compartment 12. The pulverized solid fuel nozzle 34 has a coal nozzle tip and coal nozzle body and the present invention provides a pivot mounting apparatus for pivotally mounting to one another the coal nozzle tip and coal nozzle body of a pulverized solid fuel nozzle, such as the pulverized solid fuel nozzle 34 shown in FIG. 2.

Reference is now to had FIG. 3, which illustrates a pulverized solid fuel nozzle in the form of a pulverized coal nozzle 208 having one embodiment of the inventive pivot mounting apparatus for pivotally mounting the coal nozzle tip and coal nozzle body of the pulverized solid fuel nozzle to one another, hereinafter designated as the pivot mounting apparatus 210. The pulverized coal nozzle 208 comprises a coal nozzle tip 212 and a coal nozzle body 214. As seen in FIG. 4, which is an exploded perspective elevational view, in partial section, of the pulverized coal nozzle 208 having the one embodiment of the inventive pivot mounting apparatus shown in FIG. 3, the coal nozzle tip 212 has a pair of through holes 216 and the coal nozzle body 214 has a pair of through holes 218, whereupon, to place the coal nozzle in its operating position in which the coal nozzle tip 212 is pivotally mounted to the coal nozzle body 214 of the coal nozzle, each of the coal nozzle tip through holes 216 is aligned with a respective one of the coal nozzle body through holes 218 in connection with the installation of the pivot mounting apparatus 210, such installation to be described in more detail hereinafter. Although the hereinafter following description will describe the manner in which the pivot mounting apparatus 210 is installed with respect to only a respective single one of the coal nozzle tip through holes 216 that is aligned with a respective one of the coal nozzle body through holes 218, it is to be understood that the pivot mounting apparatus 210 is installed in the same manner with respect to the other one of the coal nozzle tip through holes 216 that is aligned with the other one of the coal nozzle body through holes 218.

Figure 3:
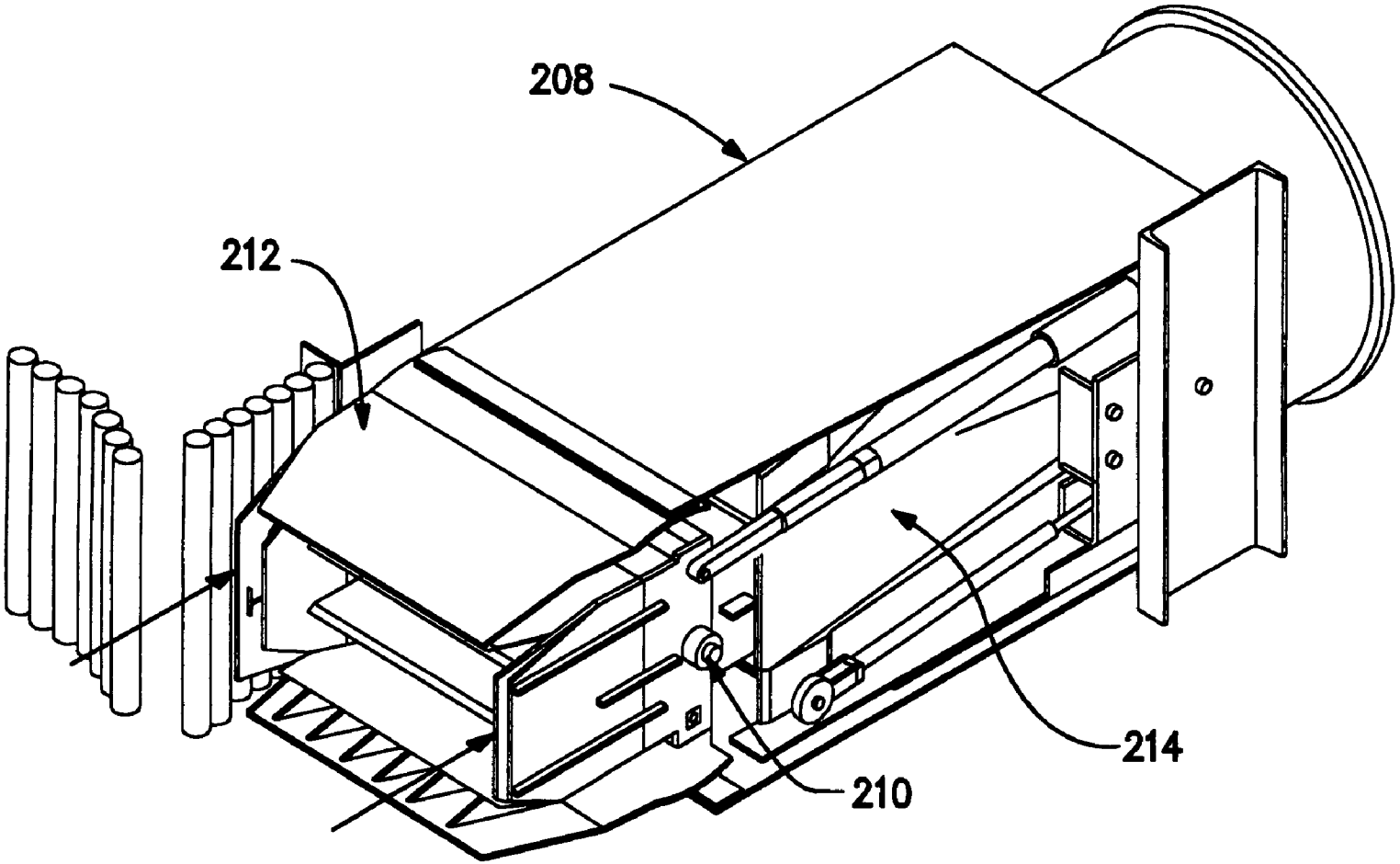
FIG. 3 is a perspective elevational view, in partial section, of the one embodiment of the inventive pivot mounting apparatus in its installed position on a coal nozzle.
Figure 4:
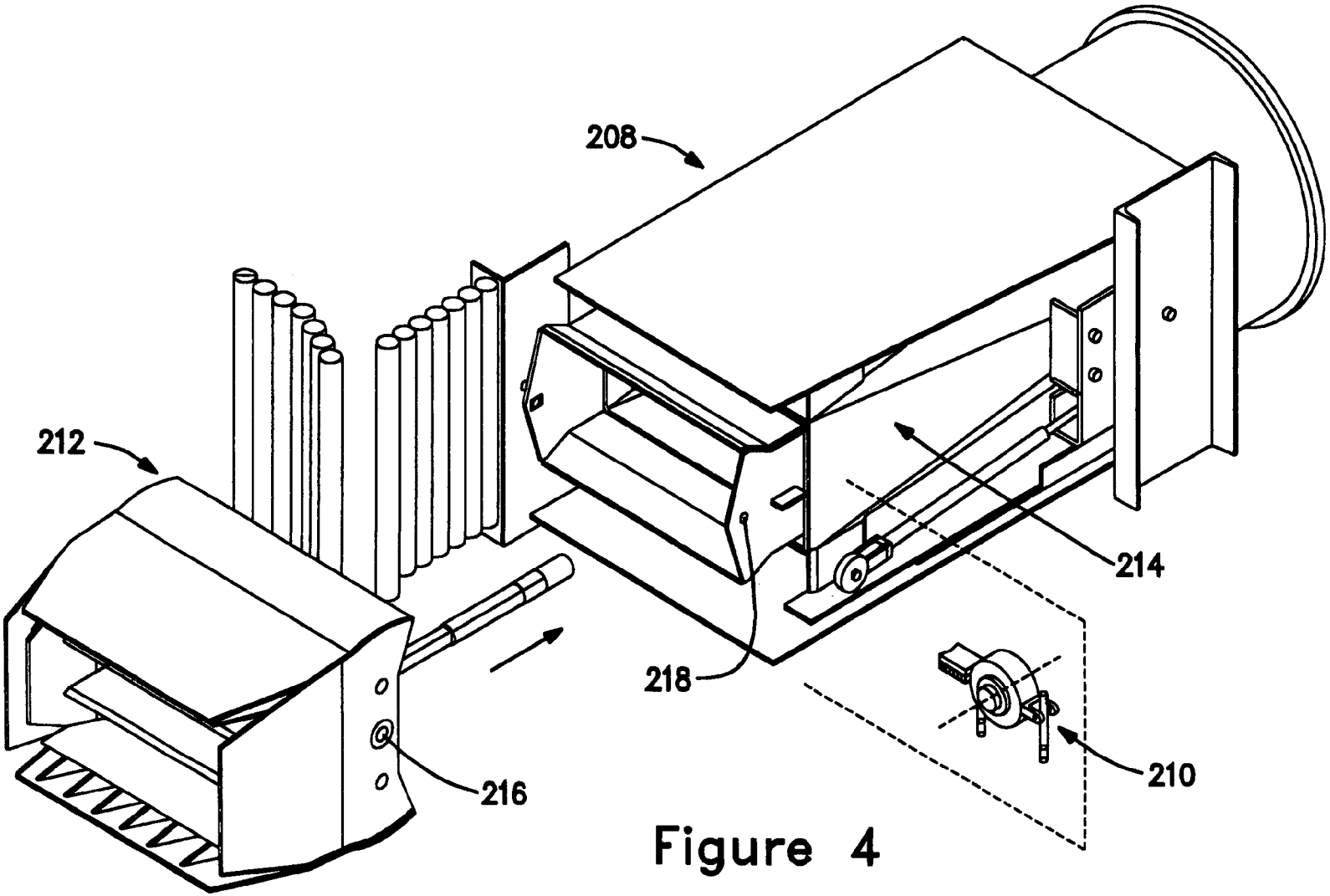
FIG. 4 is an exploded perspective elevational view, in partial section, of the coal nozzle having the one embodiment of the inventive pivot mounting apparatus shown in FIG. 3.
Figure 5:
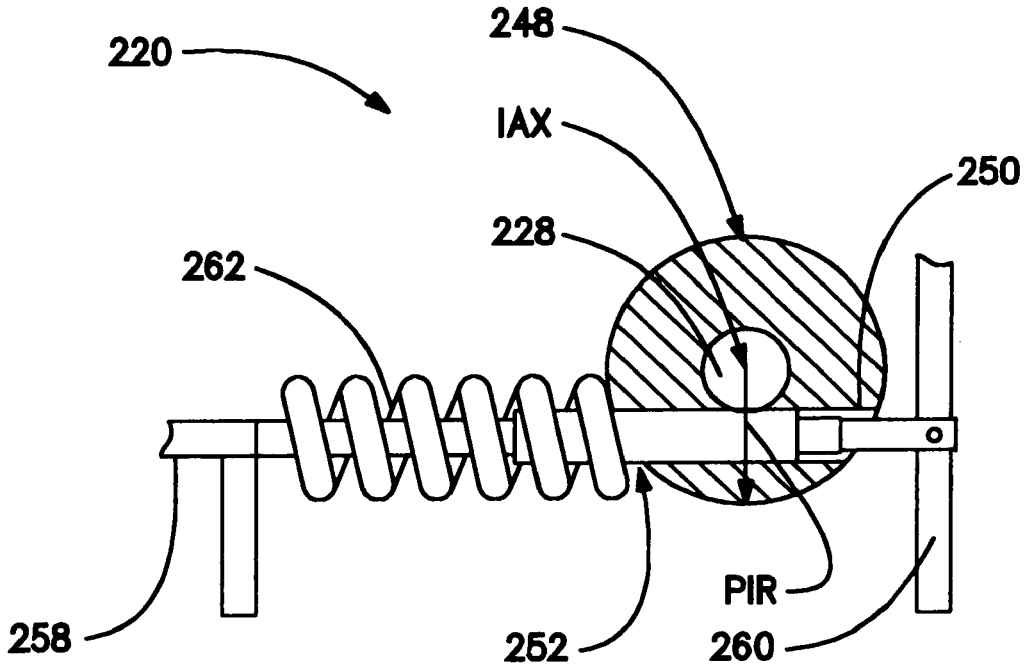
FIG. 5 is an enlarged partial sectional elevational view of the pivot mounting apparatus shown in FIG. 3.
Figure 6:
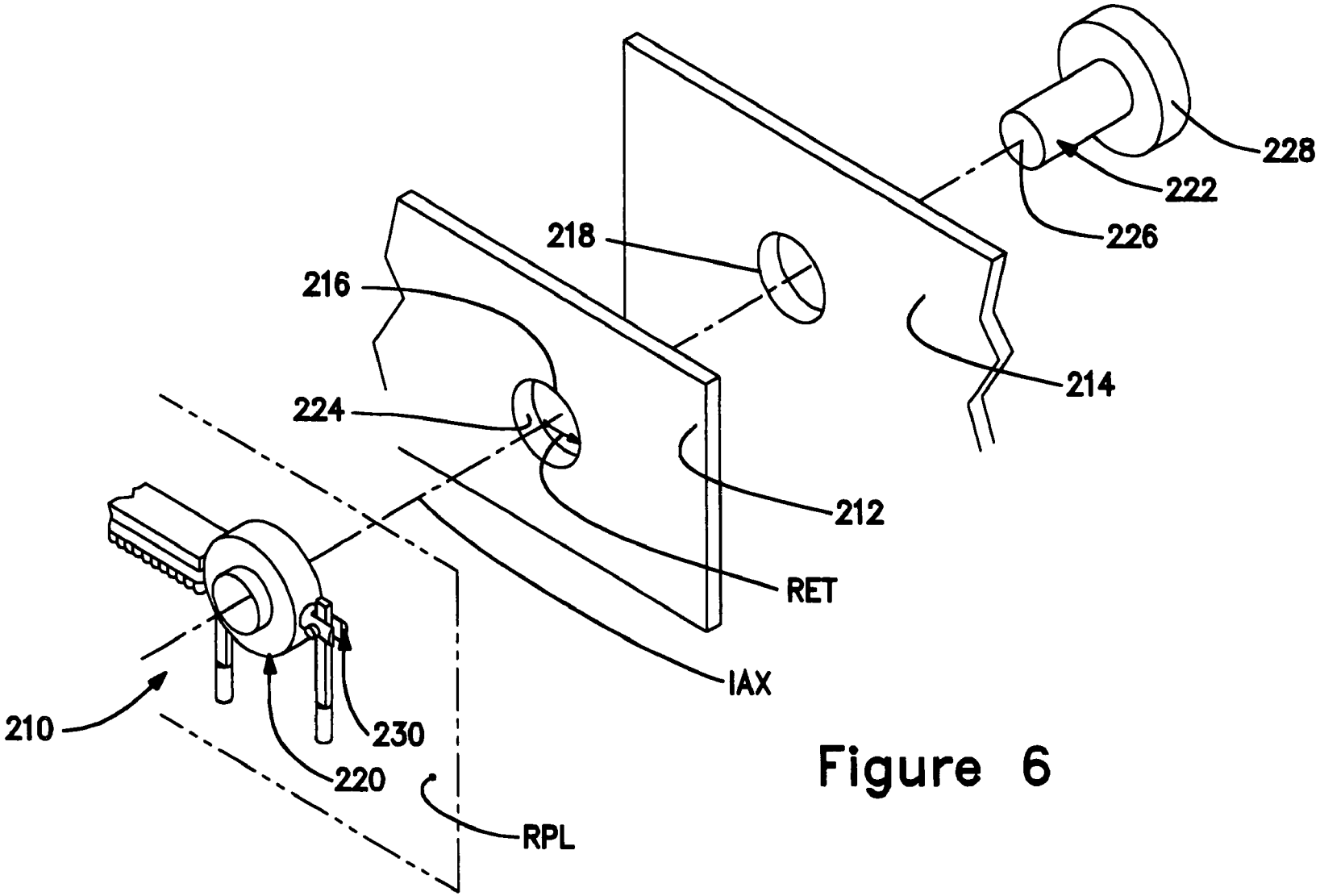
FIG. 6 is an enlarged exploded perspective view of the pivot mounting apparatus shown in FIG. 3.

As seen in FIG. 3 and FIG. 5, which is an enlarged partial sectional elevational view of the pivot mounting apparatus 210 shown in FIG. 3, the pivot mounting apparatus 210 comprises a latch interconnecting assembly 220 that includes a pin 222 for insertion in a traversing movement through an insertion passage 224 which passes through both the through hole 216 of the coal nozzle tip 212 and the through hole 218 of the coal nozzle body 214 upon the mutually facing positioning of respective sides of the coal nozzle tip 212 and the coal nozzle body 214 with one another with their respective through holes 216, 218 both co-axial with an insertion axis IAX. As can be seen in FIG. 6, which is an enlarged exploded perspective view of the pivot mounting apparatus 210 shown in FIG. 3, the insertion passage 224, in this exemplary installation arrangement, is formed of a separate passage-forming means extending through the respective aligned through holes 216, 218 of the coal nozzle tip 212 and the coal nozzle body 214, although it is to be understood, as will be described in more detail hereinafter in connection with another embodiment of the present invention, that the insertion passage 224 can alternatively be formed by the respective aligned through holes 216, 218 of the coal nozzle tip 212 and the coal nozzle body 214 themselves without a separate passage-forming means.

The pin 222 has a traverse end 226 and an inside end 228 whereupon, in the fully inserted position of the pin 228, the traverse end 226 of the pin 222 is outward of the side of the coal nozzle body 214 facing the coal nozzle tip 212 and the inside end 228 of the pin 222 is outward of the opposite non-facing side of the coal nozzle body 214. In view of the fact, noted above, that the coal nozzle tip 212 is pivotally mounted with its sides outward of the sides of the coal nozzle body 214—i.e., the sides of the coal nozzle tip 212 extend, in overlapping manner, over the furnace-side end of the coal nozzle body 214—it can be understood, as best seen in FIG. 6, that the respective side of the coal nozzle body 214 facing the coal nozzle tip 212 is the exterior side of the coal nozzle body 214 and the opposite non-facing side of the coal nozzle body 214 is the interior side of the coal nozzle body 214.

As seen in FIG. 6, the insertion passage 224 through which the pin 22 traverses has a radial extent RET as measured perpendicularly to the insertion axis IAX. This radial extent RET of the installation passage 224 is defined by a passage forming element, to be described in more detail hereinafter, that extends through the respective aligned through holes 216, 218 of the coal nozzle tip 212 and the coal nozzle body 214.

The latch interconnecting assembly 220 of the pivot mounting apparatus 210 further includes an engagement element 232 for resisting a withdrawal movement of the pin in a direction opposite to its traversing movement. In the one embodiment of the inventive pivot mounting apparatus 210 and as best seen in FIG. 5 and FIG. 6, the engagement element 232 is movable between a non-deployed position and a deployed position in which withdrawal of the pin 222 in a direction opposite to its traversing movement is resisted. The engagement element 232 and the pin 222 are cooperatively configured with respect to one another such that, in the non-deployed position of the engagement element 232, the radial extent PIR of the latch interconnecting assembly 220 (as best seen in FIG. 5), as measured through the pin 222 and the respective portion, if any, of the engagement element 232 in contact with the pin 222, is no greater than the radial extent RET of the insertion passage 224 and, in the deployed position of the engagement element 232, the radial extent PIR of the latch interconnecting assembly 220, as measured through the pin 222 and the respective portion of the engagement element 232 in contact with the pin 222, is greater than the radial extent RET of the insertion passage 224.

Figure 7:
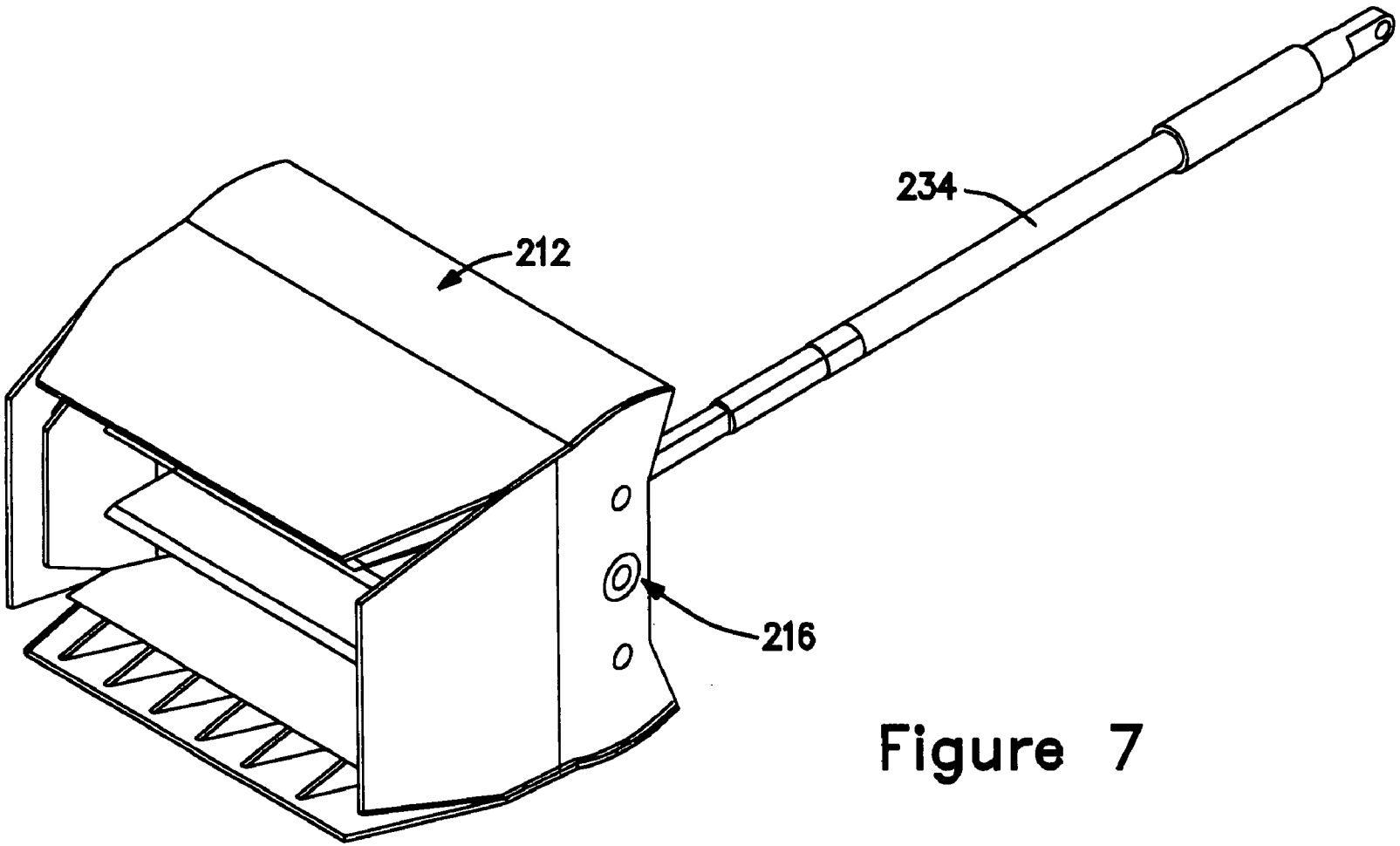
FIG. 7 is a perspective view of the coal nozzle tip in its non-installed position in which it has been removed from its pivot mounting connection with the coal nozzle body.
Figure 8:
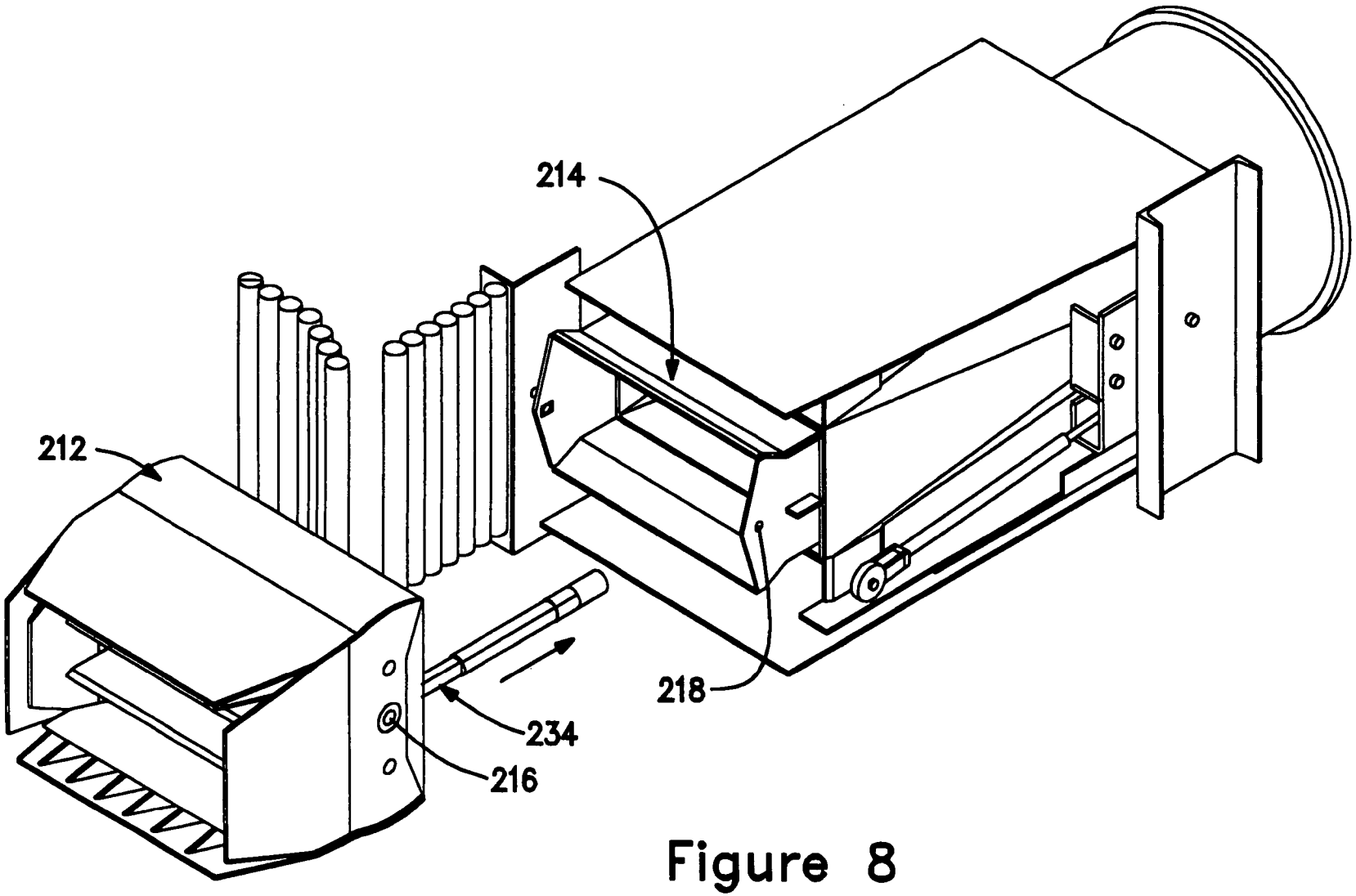
FIG. 8 is a perspective view of the coal nozzle tip during guided movement thereof into its pivot mounting connection with the coal nozzle body.

The relationship between the radial extent RET of the insertion passage 224 and the radial extent PIR of the latch interconnecting assembly 220 will become evident in the following description of the installation steps for installing the one embodiment of the inventive pivot mounting apparatus in its installed position. As seen in FIG. 7, which is a perspective view of the coal nozzle tip 212 in its non-installed position in which it has been removed from its pivot mounting connection with the coal nozzle body 214, the coal nozzle tip 212 is initially prepared for mounting into its pivot mounting connection with the coal nozzle body 214 by the securement of one end of a conventional horizontal adjusting rod 234 to the coal nozzle tip 212. It can be seen in FIG. 7 that the through holes 216 of the coal nozzle tip 212 are open—i.e., the pin 222 has not yet been inserted therethrough. Following the installation step illustrated in FIG. 7, the coal nozzle tip 212, with the horizontal adjusting rod 234 secured thereto, is then guided, as is shown in FIG. 8, onto its overlapping disposition on the coal nozzle body 214. In connection with this step, there occurs the mutually facing positioning of respective sides of the coal nozzle tip 212 and the coal nozzle body 214 with one another with their respective through holes 216, 218 being aligned with one another—each is disposed co-axial with the insertion axis LAX. Thus, each respective interior side of the coal nozzle tip 212 is in facing relationship with a respective exterior side of the coal nozzle body 214 with the respective associated through holes 216, 218 being aligned with one another.

Figure 9:
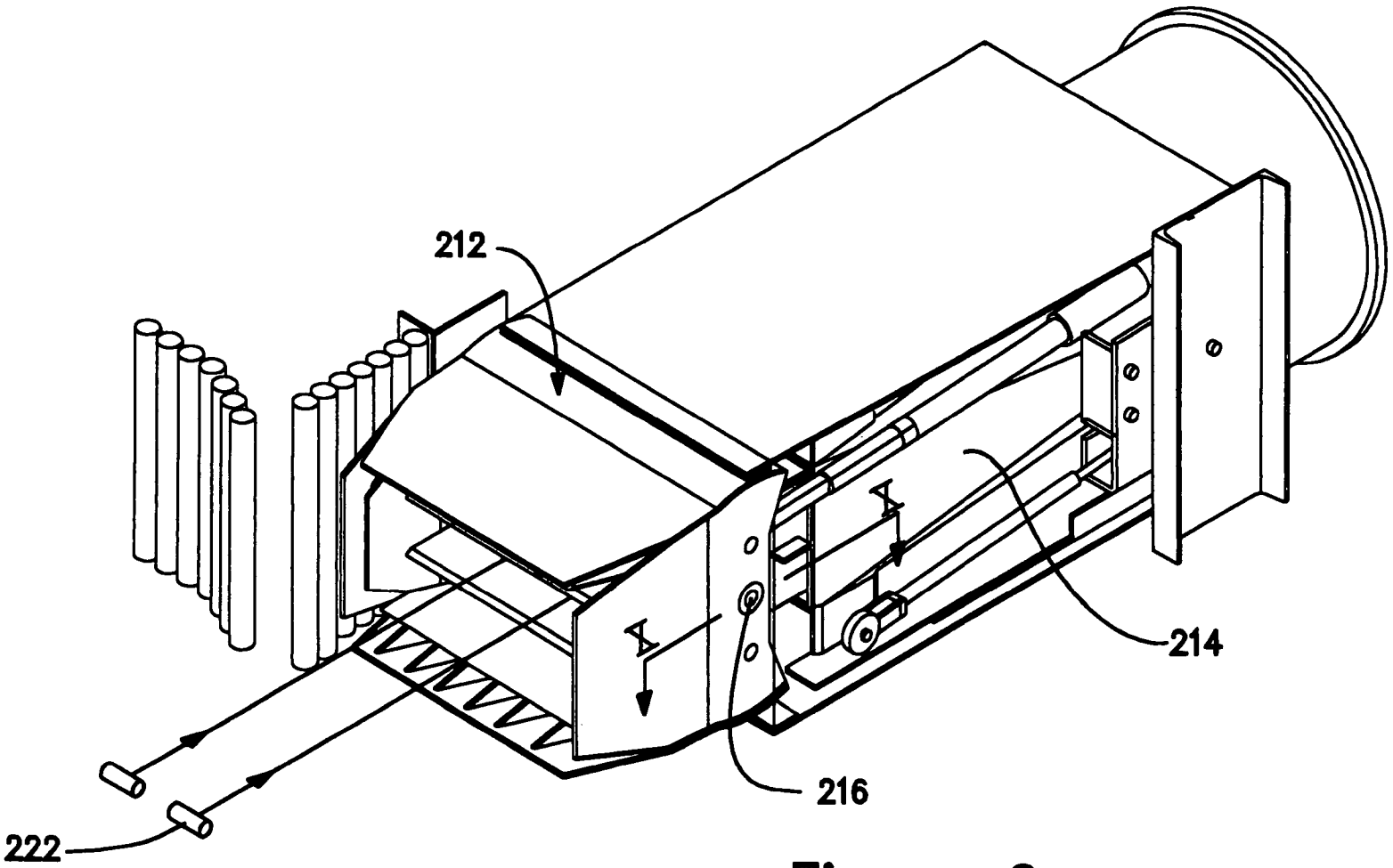
FIG. 9 is a perspective view of the coal nozzle tip in its partially overlapping disposition with the coal nozzle body.
Figure 10:
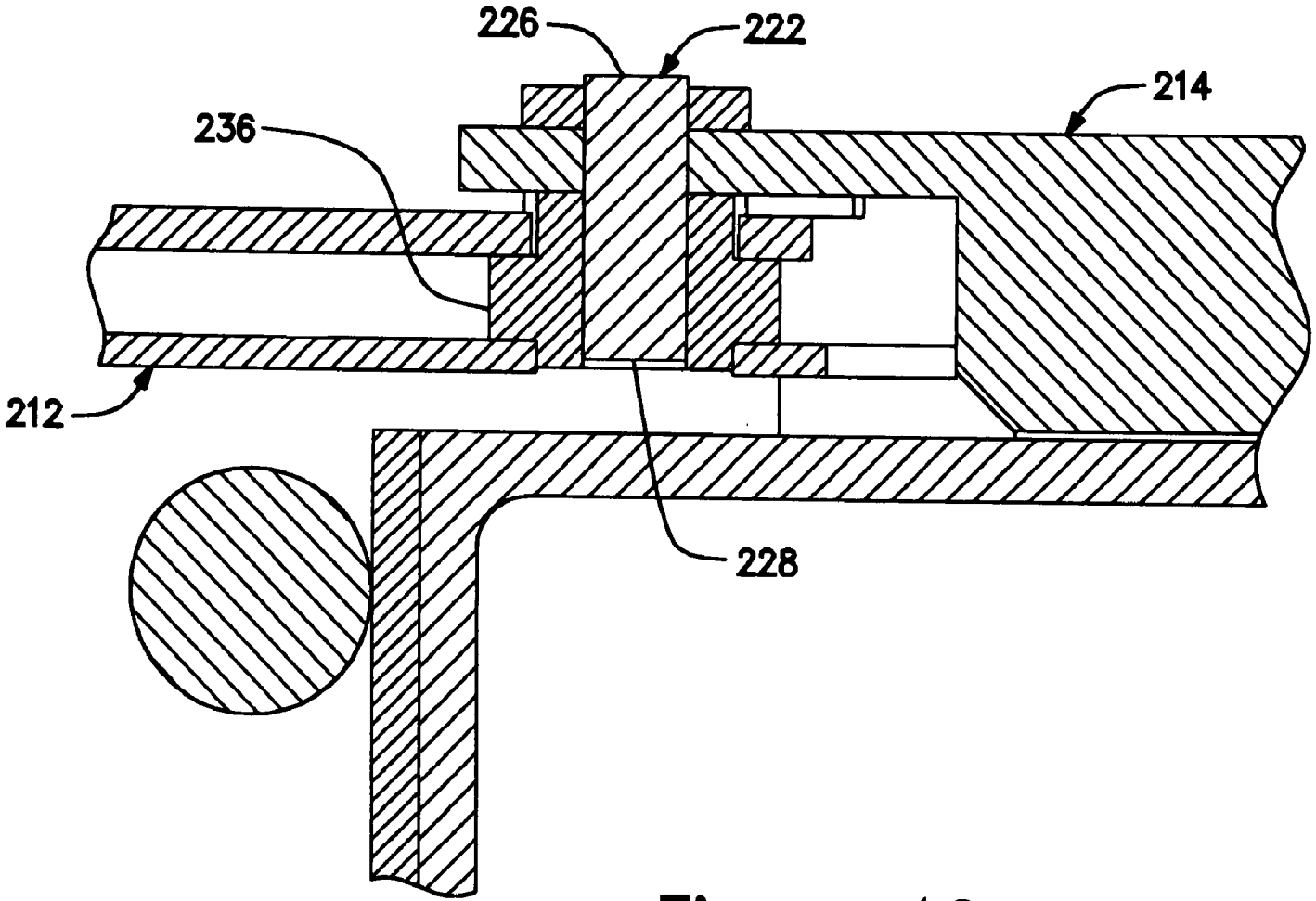
FIG. 10 is an enlarged sectional view of a portion of the mutually facing respective right-hand interior side of the coal nozzle tip in facing relationship with the respective right-hand exterior side of the coal nozzle body taken along line X—X in FIG. 9.

As seen in FIG. 9, which is a perspective view of the coal nozzle tip 212 in its partially overlapping disposition with the coal nozzle body 214, the next installation step following the installation illustrated in FIG. 8 involves the insertion of the pin 222 such that the pin traverses the insertion passage 224 formed, in this embodiment, by the respective associated pair of through holes 216, 218 on the right hand side of the coal nozzle tip 212 and the coal nozzle body 214 aligned with one another. With reference to FIG. 10, which is an enlarged sectional view of a portion of the respective right-hand interior side of the coal nozzle tip 212 in facing relationship with the respective right-hand exterior side of the coal nozzle body 214 taken along line X—X in FIG. 9, it can be seen that the pin 222, in its fully inserted position, extends fully through the insertion passage 224 such that the traverse end 226 of the pin 222 is outward of the side of the coal nozzle body 214 facing the coal nozzle tip 212 and the inside end 228 of the pin 222 is outward of the opposite non-facing side of the coal nozzle body 214.

Figure 11:
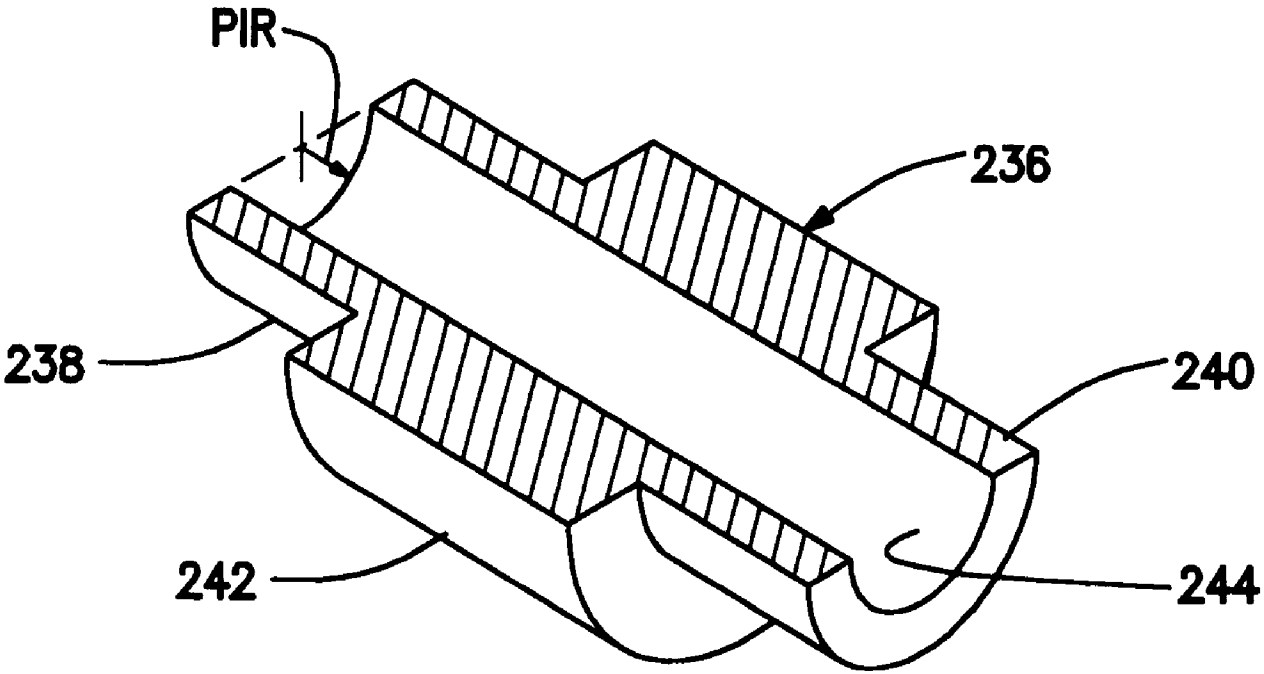
FIG. 11 is an enlarged sectional perspective view of the sleeve insert of the one embodiment of the inventive pivot mounting apparatus.

The passage-forming means that forms the insertion passage 224 is, in the one embodiment of the inventive pivot mounting apparatus, a sleeve insert 236, as is best seen in FIG. 10 and FIG. 11, which is an enlarged sectional perspective view of the sleeve insert 236. The sleeve insert 236 has a left collar portion 238 and a right collar portion 240 each having an outer diameter relatively slightly smaller than the diameter of the through hole 216 of the coal nozzle tip 212 such that the left collar portion 238 of the sleeve insert 236 is received with only a minimal play in one end of the through hole 216 and the right collar portion 240 is received with only minimal play in the other end of the through hole 216. Additionally, the sleeve insert 236 includes a middle portion 242 having a larger diameter than the left collar portion 238 and the right collar portion 240. The sleeve insert 236 has a throughbore 244 extending completely through the left collar portion 238, the right collar portion 240, and the middle portion 242 and the radius of the throughbore 244 defines the radius RET of the insertion passage 224.

The sleeve insert 236 is already positioned with the left collar portion 238 and the right collar portion 240 thereof received in the respective ends of the through hole 216 of the coal nozzle tip 212 before the coal nozzle tip 212 is guided, as is shown in FIG. 8, onto its overlapping disposition on the coal nozzle body 214. It can accordingly be seen that, in the installation step shown in FIG. 9, the insertion of the pin 222 to traverse the insertion passage 224 involves initially moving the pin 222 into the interior of the coal nozzle body 214 until the pin 222 is coaxial with the insertion axis LAX and thereafter inserting the traverse end 226 of the pin 222 initially through the throughhole 218 of the coal nozzle body 214 and subsequently completely through the throughbore 244 of the sleeve insert 236 until the traverse end 226 of the pin 222 extends outwardly of the coal nozzle body 214. To facilitate the full insertion of the pin 222, a stop flange 246 is provided at the inside end 228 of the pin 222 that abuts the interior side of the coal nozzle body 214 upon full insertion of the pin 222.

The engagement element 232, as seen in FIG. 6, comprises, in the one embodiment of the inventive pivot mounting apparatus, a cover plate 248, a detent groove 250 formed on the pin 222, and a detent latch rod 252. The cover plate 248 is fixedly secured to the exterior side of the coal nozzle tip 212 (i.e., the side of the coal nozzle tip 212 that does not face the coal nozzle body 214 in the installed position) and the cover plate includes, as best seen in FIG. 5, an axial bore 254 in which the traverse end 226 of the pin 222 is received in the fully inserted position of the pin 222 and a cross bore 256 that is perpendicular to the axial bore 254 and is radially offset therefrom. The detent groove 250 is a semi-hemispherical groove formed in the pin 222 with its groove bottom radius being less than the radius of the pin 222.

The detent latch rod 252 includes a longitudinal body 258, a drop hinge tip 260 pivotally connected to one end of the longitudinal body 258 and a coil spring 262 having one end secured to the longitudinal body 258. As seen in FIG. 5, once the pin 222 has been completely inserted into its fully inserted position in which the traverse end 226 of the pin 222 is received in the cover plate 248, the pin 222 is rotated as needed to align the detent groove 250 with the cross bore 256 of the cover plate 248. Thereafter, the drop hinge tip 260 of the detent latch rod 252, which is handled so as to be axially aligned with the longitudinal body 258 of the detent latch rod 252, is inserted fully through and beyond the cross bore 256 in the cover plate 248 to an extent such that the drop hinge tip 260 pivots downwardly, once it has cleared the cross bore 256, due to the force of gravity acting upon it. The biasing force of the coil spring 262 and the securement of the coil spring 262 to the longitudinal body 258 of the detent latch rod 252 are configured such that non-secured end of the coil spring 262 engages the side circumferential surface of the cover plate 248 and the coil spring 262 is compressed slightly as the drop hinge tip 260 of the detent latch rod 252 is moved sufficiently beyond the cross bore 256 in the cover plate 248 to ensure that the drop hinge tip 260 pivots downwardly due to the force of gravity once it has cleared the cross bore 256. Thereafter, coil spring 262 expands and thereby draws the drop hinge tip 260, in its downwardly pivoted condition, against the side circumferential surface of the cover plate 248, whereupon it can be assured that the detent latch rod 252 will not be inadvertently dislodged from its detent engaging position with the pin 222 and cover plate 248 during operation of the coal nozzle tip 212 and the coal nozzle body 214.

It can thus be appreciated that the engagement element 232 reversibly resists a withdrawal movement of the pin 222 in a direction opposite to its traversing movement with the engagement element 232 being reversibly movable between its deployed position in which the engagement element 232 engages the pin 222 to resist withdrawal movement of the pin 222 in a direction opposite to its traversing movement and a non-deployed position in which resistance of withdrawal movement of the pin 222 by the engagement element 232 is insufficient to prevent withdrawal of the pin 222 from the throughhole 216 of the coal nozzle tip 214. The path of movement of the engagement element 232 between its deployed position and its non-deployed position is such that, throughout such movement of the engagement element 232, the path of movement of the engagement element 232 can be intersected by a radial plane RPL, as seen in FIG. 6, passing through the pin 222 perpendicular to the insertion axis IAX. Additionally, in the one embodiment of the inventive pivot mounting apparatus, the engagement element 232 and the pin 222 are cooperatively configured with respect to one another such that, in the non-deployed position of the engagement element 232, the radial extent PIR of the latch interconnecting assembly 220, as measured through the pin 222 and the respective portion, if any, of the engagement element 232 in contact with the pin 222, is equal to the radius of the pin 222 and this radius is no greater than the radial extent RET of the insertion passage 224 defined by the radius of the throughbore 244 of the sleeve insert 236. Furthermore, with respect to the engagement element 232 of the one embodiment of the inventive pivot mounting apparatus, the radial extent PIR of the latch interconnecting assembly 220, as measured through the pin 222 and the respective portion of the engagement element 232 in contact with the pin 222, is greater than the radial extent RET of the insertion passage 224 in the deployed position of the engagement element 232. Specifically, the radial extent PIR of the latch interconnecting assembly 220, as measured through the pin 222 and the respective portion of the engagement element 232 in contact with the pin 222, is equal to the radial extent PIR as measured along a radius of the pin 222 perpendicular to the detent latch rod 252, whereupon this radial extent (see FIG. 5) is measured with respect to the insertion axis IAX along the so-specified radius of the pin 222 perpendicular to the detent latch rod 252 to the lower edge of the detent latch rod 252 and this radial extent is greater than the radial extent RET of the insertion passage 224.

Figure 12:
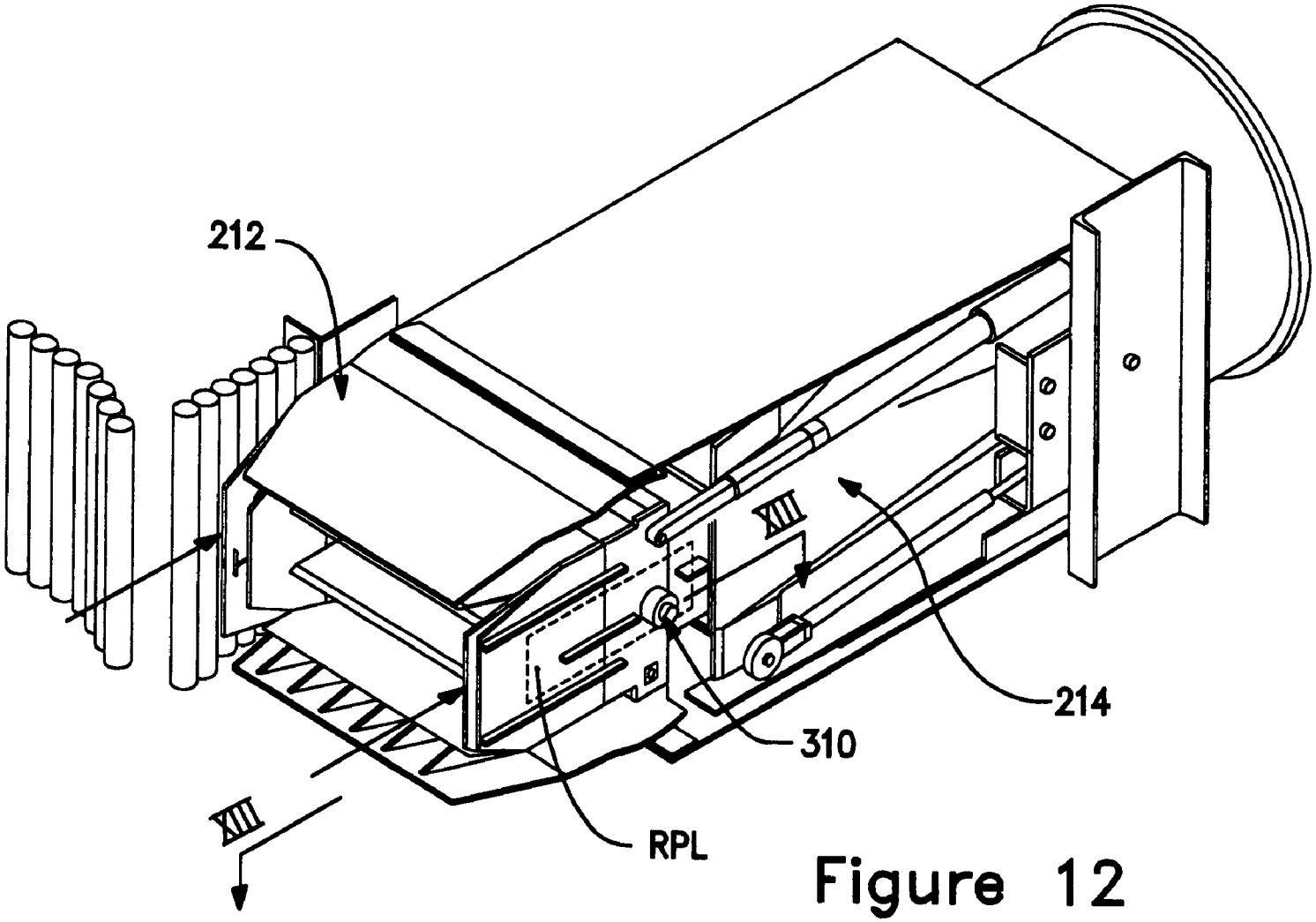
FIG. 12 is a perspective elevational view, in partial section, of another embodiment of the inventive pivot mounting apparatus in its installed position on a coal nozzle.

Reference is now had to FIG. 12, which is a perspective elevational view, in partial section, of another embodiment of the inventive pivot mounting apparatus in its installed position on a coal nozzle, hereinafter designated as the pivot mounting apparatus 310. In connection with the mounting of the coal nozzle in its operating position in which the coal nozzle tip 212 is pivotally mounted to the coal nozzle body 214 of the coal nozzle by means of the pivot mounting apparatus 310, each of the coal nozzle tip through holes 216 is aligned with a respective one of the coal nozzle body through holes 218, such installation to be described in more detail hereinafter. Although the hereinafter following description will describe the manner in which the pivot mounting apparatus 310 is installed with respect to only a respective one of the coal nozzle tip through holes 216 that is aligned with a respective one of the coal nozzle body through holes 218, it is to be understood that the pivot mounting apparatus 310 is installed in the same manner with respect to the other one of the coal nozzle tip through holes 216 that is aligned with the other one of the coal nozzle body through holes 218.

Figure 13:
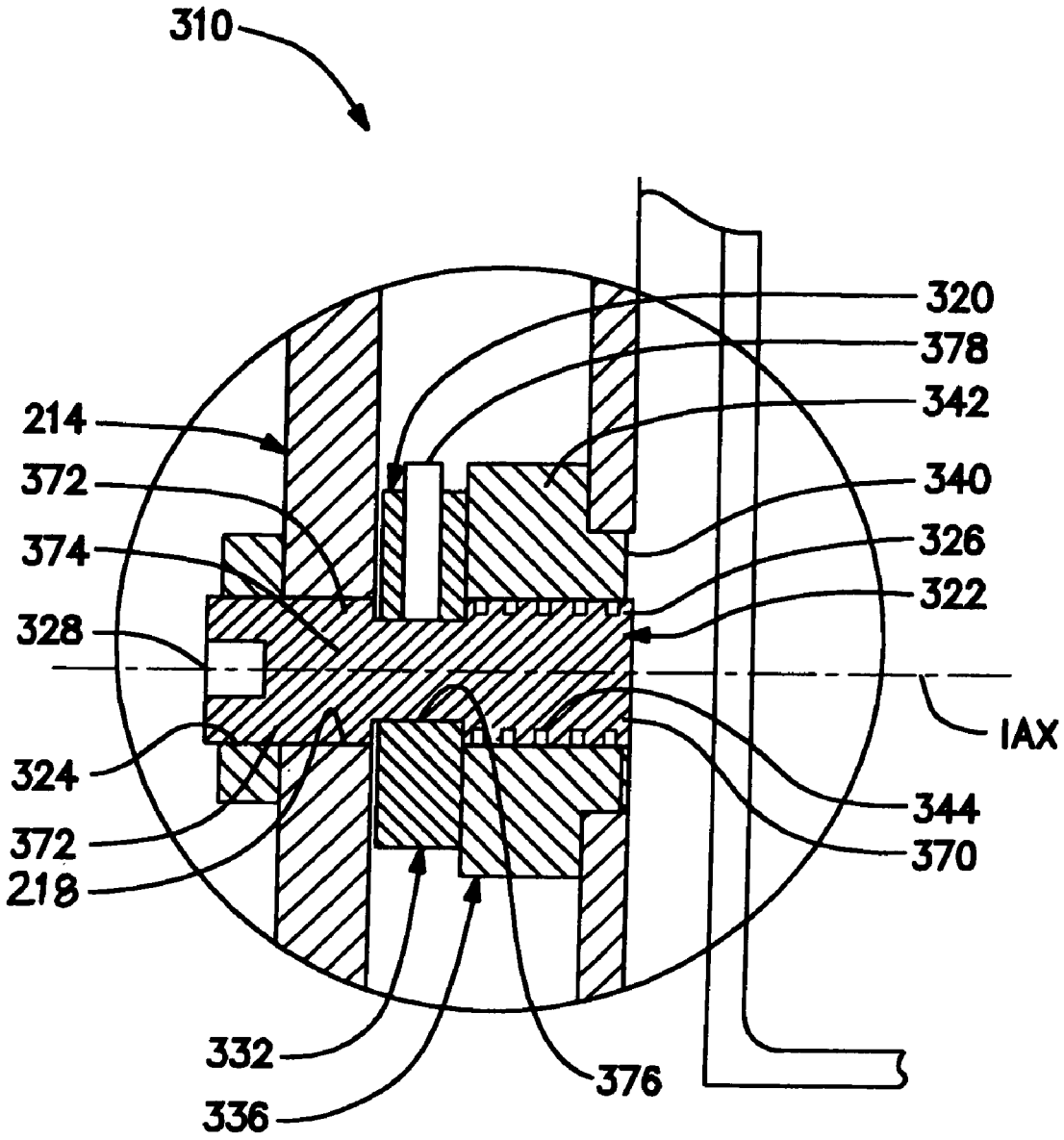
FIG. 13 is an enlarged sectional view of a portion of the mutually facing respective right-hand interior side of the coal nozzle tip in facing relationship with the respective right-hand exterior side of the coal nozzle body taken along line XIII—XIII in FIG. 12.

As seen in FIG. 13, which is an enlarged sectional view of a portion of the respective right-hand interior side of the coal nozzle tip 212 in facing relationship with the respective right-hand exterior side of the coal nozzle body 214 taken along line XIII—XIII in FIG. 12, the pivot mounting apparatus 310 comprises a latch interconnecting assembly 320 that includes a pin 322 for insertion in a traversing movement through an insertion passage 324 which passes through both the through hole 216 of the coal nozzle tip 212 and the through hole 218 of the coal nozzle body 214 upon the mutually facing positioning of respective sides of the coal nozzle tip 212 and the coal nozzle body 214 with one another with their respective through holes 216, 218 both co-axial with an insertion axis IAX. The insertion passage 324, in this exemplary installation arrangement, is partially formed, on the one hand, by a sleeve insert 336 extending through a respective pair of the aligned through holes 216, 218 of the coal nozzle tip 212 and the coal nozzle body 214 and, on the other hand, the balance of the insertion passage 324 is formed by the other through hole 218 of the coal nozzle body 214.

The pin 322 has a traverse end 326 and an inside end 328 whereupon, in the fully inserted position of the pin 328, the traverse end 326 of the pin 322 is outward of the side of the coal nozzle body 214 facing the coal nozzle tip 212 and the inside end 328 of the pin 322 is outward of the opposite non-facing side of the coal nozzle body 214. The latch interconnecting assembly 320 of the pivot mounting apparatus 310 further includes an engagement element 332 for resisting a withdrawal movement of the pin in a direction opposite to its traversing movement. The engagement element 332 is movable between a non-deployed position and a deployed position in which withdrawal of the pin 322 in a direction opposite to its traversing movement is resisted.

The sleeve insert 336 that partially forms the insertion passage 324 is, in the another embodiment of the inventive pivot mounting apparatus, a right collar portion 340 having an outer diameter relatively slightly smaller than the diameter of the through hole 216 of the coal nozzle tip 212 such that the right collar portion 340 is received with only minimal play in the through hole 216 of the coal nozzle tip 212. Additionally, the sleeve insert 336 includes a middle portion 342 having a larger diameter than the right collar portion 340. The sleeve insert 336 has a threaded throughbore 344 extending completely through the right collar portion 340 and the middle portion 342.

It can be seen that the pin 322 comprises a threaded distal portion 370 compatibly configured with respect to the threaded throughbore 344 of the sleeve insert 336 such that the threaded distal portion 370 can be meshingly engaged with the threaded throughbore 344 of the sleeve insert 336. The pin 322 comprises a proximate portion 372 and a reduced diameter mid-portion 374 intermediate the threaded distal portion 370 and the proximate portion 372. The reduced diameter mid-portion 374 has a relatively smaller diameter than the threaded distal portion 370 and the proximate portion 372. The engagement element 332 has a threaded central bore 376 compatibly configured with respect to the threaded distal portion 370 of the pin 322 such that the threaded distal portion 370 of the pin 322 can traverse completely through the threaded central bore 376 of the engagement element 332. The engagement element 332 also includes a set screw 378 threadably movable in a radial direction.

The coal nozzle tip 212 is initially prepared for mounting into its pivot mounting connection with the coal nozzle body 214 by the securement of one end of the conventional horizontal adjusting rod 234 to the coal nozzle tip 212. The through holes 216 of the coal nozzle tip 212 are open—i.e., the pin 322 has not yet been inserted therethrough. Following the installation step of the conventional horizontal adjusting rod 234, the coal nozzle tip 212, with the horizontal adjusting rod 234 secured thereto, is then guided onto its overlapping disposition on the coal nozzle body 214. In connection with this step, there occurs the mutually facing positioning of respective sides of the coal nozzle tip 212 and the coal nozzle body 214 with one another with their respective through holes 216, 218 being aligned with one another—each is disposed co-axial with the insertion axis IAX. Thus, each respective interior side of the coal nozzle tip 212 is in facing relationship with a respective exterior side of the coal nozzle body 214 with the respective associated through holes 216, 218 being aligned with one another.

The next installation step following the installation of the coal nozzle tip 212, with the horizontal adjusting rod 234 secured thereto, in its overlapping disposition on the coal nozzle body 21, involves the insertion of the pin 322 such that the pin traverses the insertion passage 324, whereupon the pin 322, in its fully inserted position, extends fully through the insertion passage 324 such that the traverse end 326 of the pin 322 is outward of the side of the coal nozzle body 214 facing the coal nozzle tip 212 and the inside end 328 of the pin 322 is outward of the opposite non-facing side of the coal nozzle body 214. In connection with this installation step, the sleeve insert 336 has already been positioned with the right collar portion 340 thereof received in the through hole 216 of the coal nozzle tip 212 before the coal nozzle tip 212 is guided onto its overlapping disposition on the coal nozzle body 214.

The insertion of the pin 322 to traverse the insertion passage 324 in a traversing movement involves initially moving the pin 322 into the interior of the coal nozzle body 214 until the pin 322 is coaxial with the insertion axis LAX and thereafter inserting the traverse end 326 of the pin 322 initially through the throughhole 218 of the coal nozzle body 214 and thereafter threading the threaded distal portion 370 of the pin 322 successively through the threaded central bore 376 of the engagement element 332 and then threading the threaded distal portion 370 of the pin 322 into threaded engagement with the threaded portion 344 of the sleeve insert 336. In connection with the threading of the threaded distal portion 370 of the pin 322 fully through the threaded central bore 376 of the engagement element 332, once the threaded distal portion 370 of the pin 322 has passed beyond the threaded central bore 376 of the engagement element 332, the reduced diameter mid-portion 374 of the pin 322 is now axially coincident with the engagement element 332 and the engagement element 332 drops downwardly onto the reduced diameter mid-portion 374 of the pin 322 due to the force of gravity acting thereon. The set screw 378 of the engagement element 332 is then rotated to move the set screw into contact with the reduced diameter mid-portion 374 of the pin 322, thereby securing the engagement element 332 to the pin 322. As can be appreciated, the engagement element 332 resists any withdrawal movement of the pin 322 in that a withdrawal movement of the pin 322—that is, a movement of the pin 322 comprising unthreading movement of the threaded distal portion 370 of the pin 322 relative to the threaded portion 344 of the sleeve insert 336—will bring the engagement element 332 into contact with the outward side of the coal nozzle body 214 in the vicinity of the throughhole 218 of the coal nozzle body 214 and this contact will resist further withdrawal movement of the pin 322.

It can thus be appreciated that the engagement element 332 reversibly resists a withdrawal movement of the pin 322 in a direction opposite to its traversing movement with the engagement element 332 being reversibly movable between its deployed position in which the engagement element 332 engages the pin 322 to resist withdrawal movement of the pin 322 in a direction opposite to its traversing movement and a non-deployed position in which withdrawal movement of the pin 322 is not resisted by the engagement element 332, at least to an extent sufficient for the pin 322 to be withdrawn from the throughhole 216 of the coal nozzle tip 214. The path of movement of the engagement element 332 between its deployed position and its non-deployed position is such that, throughout such movement of the engagement element 332, the path of movement of the engagement element 332 can be intersected by a radial plane RPL, as seen in FIG. 12, passing through the pin 322 perpendicular to the insertion axis LAX. Additionally, in the one embodiment of the inventive pivot mounting apparatus, the engagement element 332 and the pin 322 are cooperatively configured with respect to one another such that, in the non-deployed position of the engagement element 332, the radial extent PIR of the latch interconnecting assembly 320, as measured through the pin 322 and the respective portion, if any, of the engagement element 332 in contact with the pin 322, is equal to the radius of the pin 322 and this radius is no greater than the radial extent RET of the insertion passage 324 defined by the radius of the throughbore 344 of the sleeve insert 336. Furthermore, with respect to the engagement element 332 of the one embodiment of the inventive pivot mounting apparatus, the radial extent PIR of the latch interconnecting assembly 320, as measured through the pin 322 and the respective portion of the engagement element 332 in contact with the pin 322, is greater than the radial extent RET of the insertion passage 324 in the deployed position of the engagement element 332. Specifically, the radial extent PIR of the latch interconnecting assembly 320, as measured through the pin 322 and the respective portion of the engagement element 332 in contact with the pin 322, is equal to the radial extent PIR as measured along a radius of the pin 322 perpendicular to the detent latch rod 352, whereupon this radial extent is measured with respect to the insertion axis IAX along the so-specified radius of the pin 322 perpendicular to the detent latch rod 352 to the lower edge of the detent latch rod 352 and this radial extent is greater than the radial extent RET of the insertion passage 324.

Figure 14:
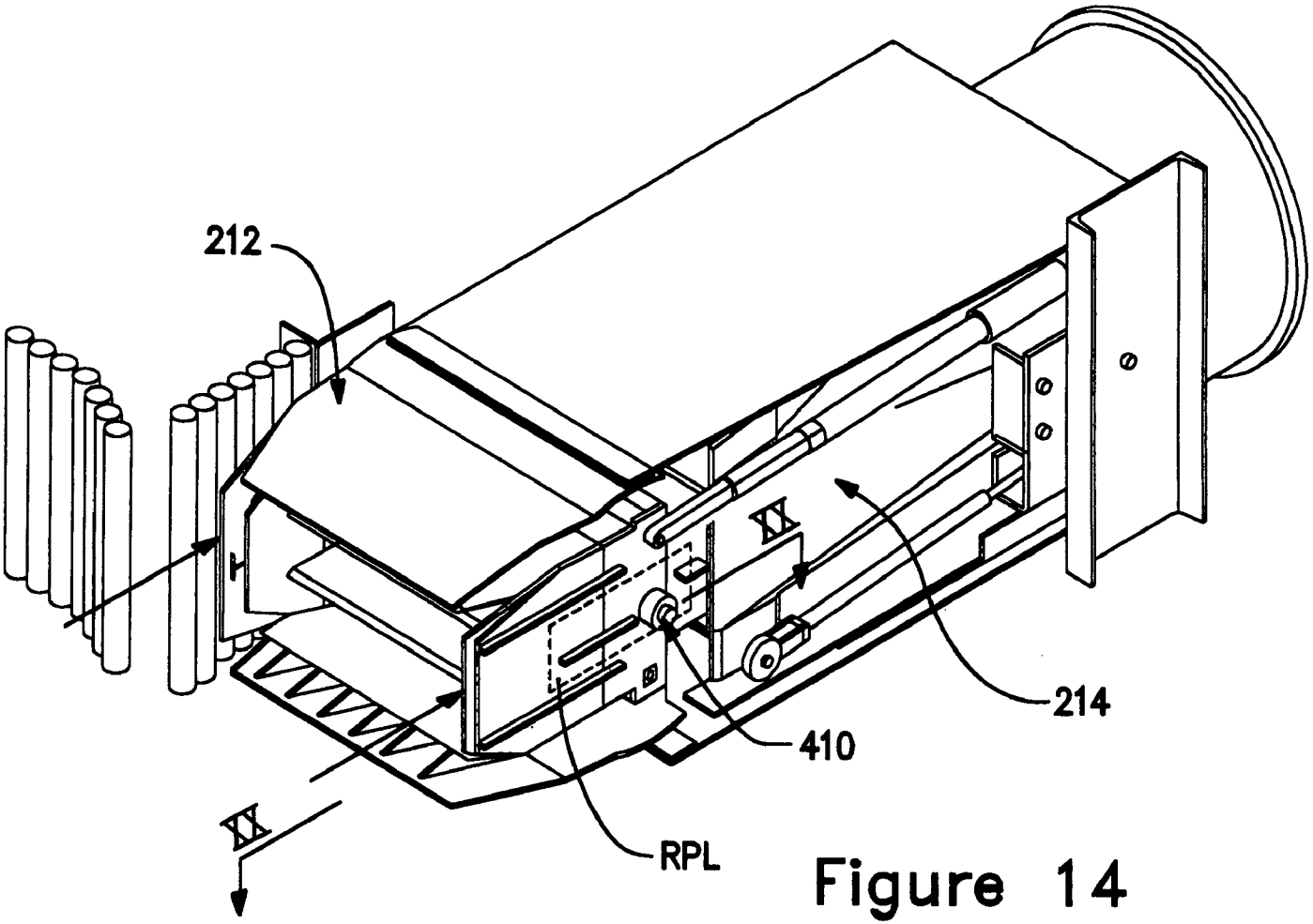
FIG. 14 is a perspective elevational view, in partial section, of a further embodiment of the inventive pivot mounting apparatus in its installed position on a coal nozzle.

Reference is now had to FIG. 14, which is a perspective elevational view, in partial section, of a further embodiment of the inventive pivot mounting apparatus in its installed position on a coal nozzle, hereinafter designated as the pivot mounting apparatus 410. In connection with the mounting of the coal nozzle in its operating position in which the coal nozzle tip 212 is pivotally mounted to the coal nozzle body 214 of the coal nozzle by means of the pivot mounting apparatus 410, each of the coal nozzle tip through holes 216 is aligned with a respective one of the coal nozzle body through holes 218, such installation to be described in more detail hereinafter. Although the hereinafter following description will describe the manner in which the pivot mounting apparatus 410 is installed with respect to only a respective one of the coal nozzle tip through holes 216 that is aligned with a respective one of the coal nozzle body through holes 218, it is to be understood that the pivot mounting apparatus 410 is installed in the same manner with respect to the other one of the coal nozzle tip through holes 216 that is aligned with the other one of the coal nozzle body through holes 218.

Figure 15:
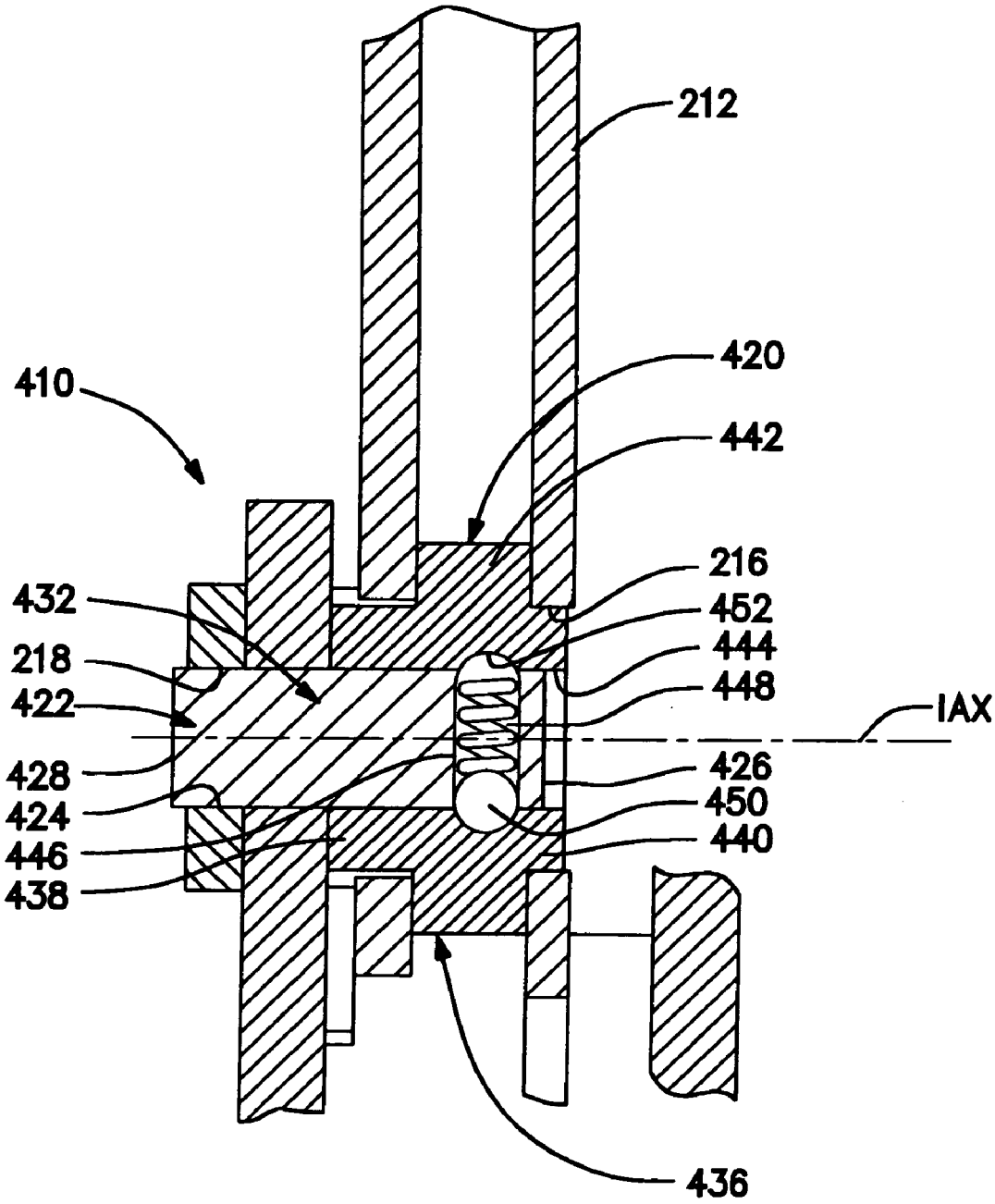
FIG. 15 is an enlarged sectional view of a portion of the mutually facing respective right-hand interior side of the coal nozzle tip in facing relationship with the respective right-hand exterior side of the coal nozzle body taken along line XV—XV in FIG. 14.

With reference to FIG. 15, which is an enlarged sectional view of a portion of the respective right-hand interior side of the coal nozzle tip 212 in facing relationship with the respective right-hand exterior side of the coal nozzle body 214 taken along line XV—XV in FIG. 14, it can be seen that the pivot mounting apparatus 410 comprises a latch interconnecting assembly 420 that includes a pin 422 for insertion in a traversing movement through an insertion passage 424 which passes through both the through hole 216 of the coal nozzle tip 212 and the through hole 218 of the coal nozzle body 214 upon the mutually facing positioning of respective sides of the coal nozzle tip 212 and the coal nozzle body 214 with one another with their respective through holes 216, 218 both co-axial with an insertion axis IAX. The insertion passage 424, in this exemplary installation arrangement, is formed by a sleeve insert 436 extending through a respective pair of the aligned through holes 216, 218 of the coal nozzle tip 212 and the coal nozzle body 214 and through the through hole 218 of the coal nozzle body 214.

The pin 422 has a traverse end 426 and an inside end 428 whereupon, in the fully inserted position of the pin 428, the traverse end 426 of the pin 422 is outward of the side of the coal nozzle body 214 facing the coal nozzle tip 212 and the inside end 428 of the pin 422 is outward of the opposite non-facing side of the coal nozzle body 214. The latch interconnecting assembly 420 of the pivot mounting apparatus 410 further includes an engagement element 432 for resisting a withdrawal movement of the pin in a direction opposite to its traversing movement. The engagement element 432 is movable between a non-deployed position and a deployed position in which withdrawal of the pin 422 in a direction opposite to its traversing movement is resisted.

The sleeve insert 436 that forms the insertion passage 424 is, in the further embodiment of the inventive pivot mounting apparatus, has a left collar portion 438 and a right collar portion 440 each having an outer diameter relatively slightly smaller than the diameter of the through hole 216 of the coal nozzle tip 212 such that the left collar portion 438 of the sleeve insert 436 is received with only a minimal play in one end of the through hole 216 and the right collar portion 440 is received with only minimal play in the other end of the through hole 216. Additionally, the sleeve insert 436 includes a middle portion 442 having a larger diameter than the left collar portion 438 and the right collar portion 440. The sleeve insert 436 has a throughbore 444 extending completely through the left collar portion 438, the right collar portion 440, and the middle portion 442.

The pin 422 includes an annular cross-bore 446 extending completely along a diametrical line of the pin 422. A spring 448 and a solid ball 450 are disposed in the cross-bore 446. The sleeve insert 436 includes a semi-cylindrical groove 452 opening into the hollow center of the sleeve insert. One end of the spring 448 is in engagement with the groove 452 and the other end of the spring 448 presses against the solid ball 450 to continually bias or urge the solid ball 450 radially outwardly relative to the pin 422. Thus, upon axial alignment relative to the axis IAX of the annular cross-bore 446 of the pin 422 and the groove 452 of the sleeve insert 436, the spring 448 urges the solid ball 450 partially radially outwardly of the cross-bore 446 of the pin 422 to seat in the groove 452 of the sleeve insert 436. This seating of the solid ball 450 in the groove 452 of the sleeve insert 436 permits the engagement element 432 to resist withdrawal movement of the pin 422 in the deployed position of the engagement element.

It can thus be appreciated that the engagement element 432 reversibly resists a withdrawal movement of the pin 422 in a direction opposite to its traversing movement with the engagement element 432 being reversibly movable between its deployed position in which the engagement element 432 engages the pin 422 to resist withdrawal movement of the pin 422 in a direction opposite to its traversing movement and a non-deployed position in which withdrawal movement of the pin 422 is not resisted by the engagement element 432, at least to an extent sufficient for the pin 422 to be withdrawn from the throughhole 216 of the coal nozzle tip 214. The path of movement of the engagement element 432 between its deployed position and its non-deployed position is such that, throughout such movement of the engagement element 432, the path of movement of the engagement element 432 can be intersected by a radial plane RPL, as seen in FIG. 14, passing through the pin 422 perpendicular to the insertion axis IAX.

While an embodiment and variations of the present invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

What is claimed is:

1. An apparatus for pivotally mounting one side of a coal nozzle tip of a coal nozzle operable in a pulverized solid fuel-fired furnace to a coal nozzle body of the coal nozzle, the one side of the coal nozzle tip having a through hole therethrough and the coal nozzle tip and the coal nozzle body being mounted relative to one another such that the one side of the coal nozzle tip is outward of the coal nozzle body, the apparatus comprising:

a latch interconnecting assembly including:

a pin for insertion in a traversing movement along an insertion axis through both the through hole of the coal nozzle tip and a correspondingly aligned pivot support hole of the coal nozzle body, the pin having a traverse end and an inside end with the traverse end of the pin being inserted during the traversing movement initially through the pivot support hole of the coal nozzle body and thereafter through the through hole of the one side of the coal nozzle tip, whereupon, in the fully inserted position of the pin, the traverse end of the pin is outward of the one side of the coal nozzle body and the inside end of the pin is inward of the coal nozzle body; and an engagement element for resisting a withdrawal movement of the pin in a direction opposite to its traversing movement, the engagement element being reversibly movable between a deployed position in which the engagement element engages the pin to resist withdrawal movement of the pin in a direction opposite to its traversing movement and a non-deployed position in which resistance of withdrawal movement of the pin by the engagement element is insufficient to prevent withdrawal of the pin from the throughhole of the coal nozzle tip, the path of movement of the engagement element between its deployed position and its non-deployed position being such that, throughout such movement of the engagement element, the path of movement of the engagement element can be intersected by a radial plane passing through the pin perpendicular to the insertion axis.

2. An apparatus for pivotally mounting one side of a coal nozzle tip to a coal nozzle body according to claim 1, wherein the combined radial extent of the engagement element and the contact portion of the pin, as measured in the deployed position of the engagement element, is greater than the radial extent of the insertion passage.

3. An apparatus for pivotally mounting one side of a coal nozzle tip to a coal nozzle body according to claim 1, wherein movement of the engagement element from its non-deployed position into its deployed position effects a change in the combined radial extent of the engagement element and the pin, as measured through the engagement element and the contact portion of the pin.

4. An apparatus for pivotally mounting one side of a coal nozzle tip to a coal nozzle body according to claim 1, wherein the engagement element is disposed inwardly of the outwardly facing surface of the coal nozzle tip.

5. An apparatus for pivotally mounting one side of a coal nozzle tip to a coal nozzle body according to claim 1, wherein at which the reversibly increasing means increases the radial extent of the latch interconnecting assembly with the reversibly increasing means being at a different radial spacing from the insertion axis in its deployed position than the radial spacing of the reversibly increasing means from the insertion axis in its non-deployed position.

6. A fuel compartment for injecting for delivering pulverized solid fuel to a combustion vessel for combustion of the pulverized solid fuel thereat in a combustion process; comprising:

a coal nozzle having a coal nozzle tip, a coal nozzle body, and an apparatus for pivotally mounting one side of a coal nozzle tip to a coal nozzle body, the one side of the coal nozzle tip having a through hole therethrough and the coal nozzle tip and the coal nozzle body being mounted relative to one another such that the one side of the coal nozzle tip is outward of the coal nozzle body, the apparatus for pivotally mounting one side of a coal nozzle tip to a coal nozzle body including:

a latch interconnecting assembly including:

a pin for insertion in a traversing movement along an insertion axis through both the through hole of the coal nozzle tip and a correspondingly aligned pivot support hole of the coal nozzle body, the pin having a traverse end and an inside end with the traverse end of the pin being inserted during the traversing movement initially through the pivot support hole of the coal nozzle body and thereafter through the through hole of the one side of the coal nozzle tip, whereupon, in the fully inserted position of the pin, the traverse end of the pin is outward of the one side of the coal nozzle body and the inside end of the pin is inward of the coal nozzle body; and an engagement element for resisting a withdrawal movement of the pin in a direction opposite to its traversing movement, the engagement element being reversibly movable between a deployed position in which the engagement element engages the pin to resist withdrawal movement of the pin in a direction opposite to its traversing movement and a non-deployed position in which resistance of withdrawal movement of the pin by the engagement element is insufficient to prevent withdrawal of the pin from the throughhole of the coal nozzle tip, the path of movement of the engagement element between its deployed position and its non-deployed position being such that, throughout such movement of the engagement element, the path of movement of the engagement element can be intersected by a radial plane passing through the pin perpendicular to the insertion axis.

* * * * *